United States Patent [19]

Phillips et al.

[11] Patent Number: 4,931,769

[45] Date of Patent: Jun. 5, 1990

[54] METHOD AND APPARATUS FOR CONTROLLING THE OPERATION OF A SECURITY SYSTEM

[75] Inventors: Kirk B. Phillips, Wilkesboro; Peter Kastan, Hickory, both of N.C.

[73] Assignee: Moose Products, Inc., Hickory, N.C.

[21] Appl. No.: 271,009

[22] Filed: Nov. 14, 1988

[51] Int. Cl.[5] ..... G08B 13/00

[52] U.S. Cl. ..... 340/541; 340/825.32; 340/506

[58] Field of Search ..... 340/541, 540, 505, 506, 340/712, 825.32, 825.31, 826.34; 341/22, 23; 235/382.5; 364/225.2

[56] References Cited

U.S. PATENT DOCUMENTS

| | | | |
|---|---|---|---|
| 4,021,796 | 5/1977 | Fawcett, Jr. et al. | 340/500 |
| 4,023,139 | 5/1977 | Samborg | 340/506 |
| 4,186,871 | 2/1980 | Anderson et al. | 340/825.31 |
| 4,333,090 | 6/1982 | Hirsch | 341/23 |
| 4,425,627 | 1/1984 | Eibner | 341/23 |
| 4,502,048 | 2/1985 | Rehm | 340/825.31 |
| 4,532,507 | 7/1985 | Edson et al. | 340/541 |
| 4,538,138 | 8/1985 | Harvey et al. | 340/521 |
| 4,570,217 | 2/1986 | Allen et al. | 364/188 |
| 4,602,246 | 7/1986 | Jensen | 340/521 |
| 4,724,425 | 2/1988 | Gerhart et al. | 340/539 |
| 4,766,746 | 8/1988 | Henderson et al. | 70/63 |

OTHER PUBLICATIONS

Ademco, Ademco's Alpha Vista, 1988.

*Primary Examiner*—Joseph A. Orsino
*Assistant Examiner*—Geoff Sutcliffe
*Attorney, Agent, or Firm*—Bell, Seltzer, Park & Gibson

[57] ABSTRACT

A security system includes a display for displaying user prompts to select from a set of alternative options for controlling the system, so that the user may respond by selecting one of the options. If further information is necessary, second and subsequent sets of options are displayed for user selection. If an authorization code is required, a prompt for an authorization code is displayed. The sets of options are preferably displayed adjacent a keypad, so that an option may be selected by actuating the key adjacent the selected option. Sequences of commands need not be memorized by a user, and complicated keyboards are not required to control the security system.

26 Claims, 5 Drawing Sheets

METHOD AND APPARATUS FOR CONTROLLING THE OPERATION OF A SECURITY SYSTEM

FIELD OF THE INVENTION

This invention relates to security systems in general and more specifically to a method and apparatus for controlling the operation of a security system.

BACKGROUND OF THE INVENTION

Security systems are increasingly used to protect people and valuables against crime, fire and other occurrences. Present day security systems are typically controlled by a microprocessor to provide greater sophistication and enhanced flexibility. The control terminal for the security system typically includes a keypad and display under microprocessor control.

Unfortunately, the increased sophistication and flexibility of microprocessor controlled security systems has created added complexity for operation. This complexity is a source of user frustration. Even more importantly, complex operation may cause the user to trigger a false alarm, or the alarm may fail to detect an emergency because of a user error in arming the system.

The task of arming and disarming a security system illustrates these problems. To arm the system the user must typically depress a sequence of number keys constituting an authorization code, followed or preceded by depressing an "arm" key. To disarm the system the authorization code and a "disarm" key must be depressed in a predefined sequence. If the sequence is not correct, the alarm will not arm or disarm. As the number of detectors and the number of alarm types increase, arming and disarming the system for different situations requires the input of longer sequences of command keystrokes. Moreover, to reduce the number of keys at the keypad, each key typically has multiple labels to serve multiple functions. The user must interpret the labels to determine the function being served by the key at a particular point in time.

SUMMARY OF THE INVENTION

It is therefore an object of the present invention to provide a method and apparatus for controlling the operation of a security system.

It is another object of the invention to provide security system operation control which is easy to use.

It is a further object of the invention to provide a user interface for a security system in which sequences of commands need not be memorized.

It is yet another object of the invention to provide a security system in which multiple label keys are not needed.

These and other objects are provided according to the present invention by a security system which includes a display for displaying messages (prompts) to a user including a first set of alternative options for controlling the security system. The user then responds by selecting one of the first set of alternative options. If further information is necessary, a second set of options is displayed so that the user may select one of the second set of options. This process continues until the security system causes the user to choose from all the options necessary to control the system. If an authorization code is required to implement a particular function, a prompt for an authorization code is displayed. If the authorization code is valid then the previously entered options will be carried out by the system.

In a preferred embodiment of the invention the keypad is located adjacent the display so that sets of options may be displayed adjacent to respective keys in the keypad. An option may then be selected by actuating the key adjacent the selected option. When an option in a second set of options must be selected, the display is simply changed to label the keys for the second set of options. This concept of "soft" or "programmable" keys eliminates the need for multiple-label keys while allowing flexibility of operation.

According to the invention, user prompts and programmable keys may be used to arm a security system or a portion thereof, to bypass one or more zones, to test the status of the zones, and to trigger and disarm the security system. Other functions of a security system may be easily integrated into the invention. Sequences of commands need never be memorized and multiple key labels need never be interpreted. Thus, even in an emergency situation, the user may quickly and easily operate the security system.

DESCRIPTION OF THE PREFERRED EMBODIMENT

The present invention now will be described more fully hereinafter with reference to the accompanying drawings, in which a preferred embodiment of the invention is shown. Like characters refer to like elements throughout. This invention may, however, be embodied in many different forms and should not be construed as limited to the embodiment set forth herein; rather, applicants provide this embodiment so that this disclosure will be thorough and complete, and will fully convey the scope of the invention to those skilled in the art.

Figure 1:
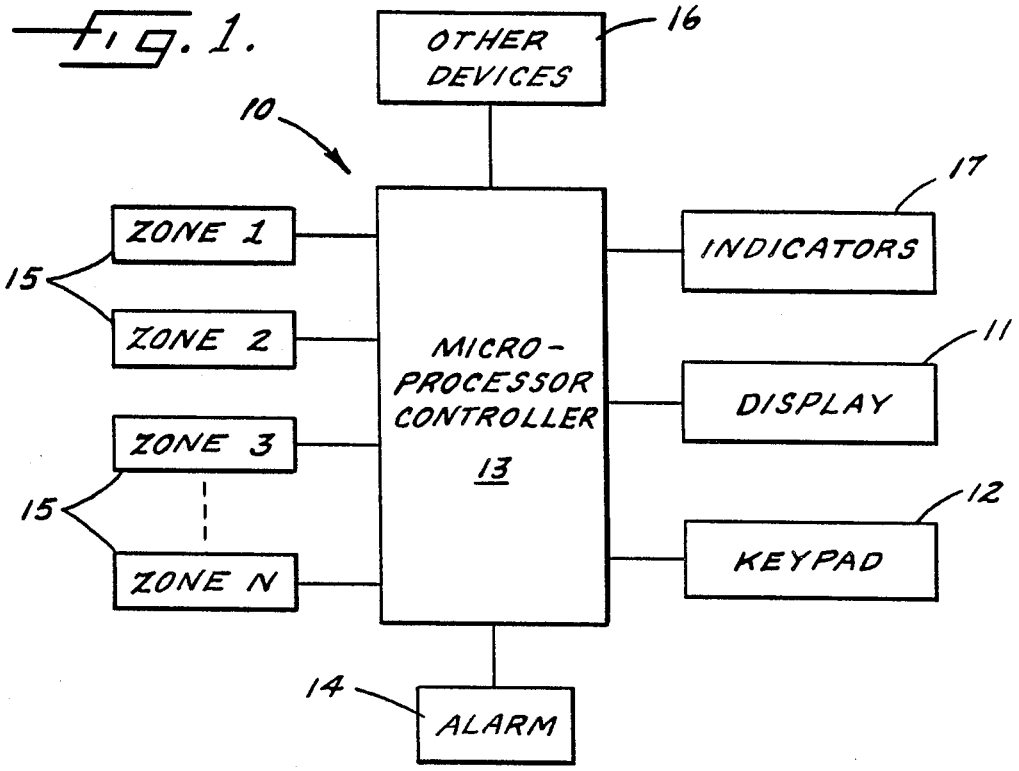
FIG. 1 is a block diagram of a microprocessor controlled security system incorporating the present invention.

Referring now to FIG. 1 a block diagram of a microprocessor controlled security system 10 according to the invention is shown. The security system includes a microprocessor controller 13 for controlling the operation thereof. A user interface is provided by a display 11, for example a two line liquid crystal display (LCD), a keypad 12, and indicators 17, for example lamps or light emitting diodes. Also connected to microprocessor 13 are a number of zone monitors 15 for monitoring windows, doors, motion, fire, and other detectors. An alarm 14 is also connected to microprocessor 13. Other devices 16, for example an automatic telephone dialing machine, may be connected to the microprocessor 13. Each of the elements of FIG. 1, and their design and interconnection to form a security system, are well known to those having skill in the art and will not be described further.

Figure 2:
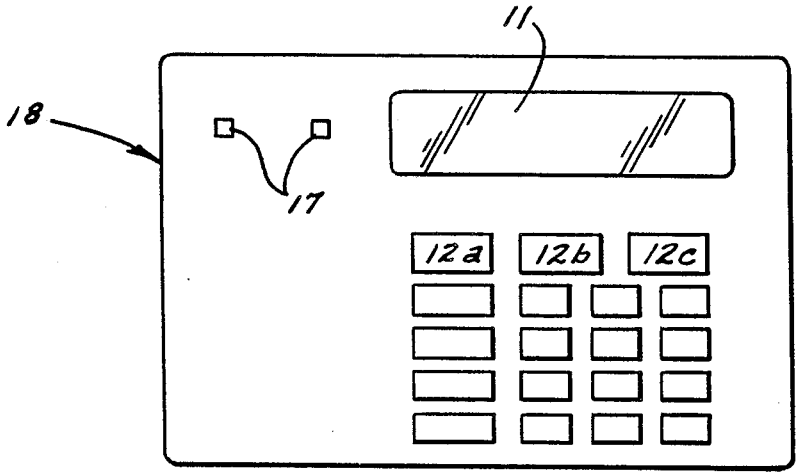
FIG. 2 is a simplified representation of the display and keypad which may be employed with the present invention.

Referring now to FIG. 2, there is shown a simplified representation of terminal 18 for providing a user interface for controlling operation of the security system. Terminal 18 includes display 11, keypad 12 and indicators 17. It will be seen that keys 12*a*, 12*b*, and 12*c* are adjacent the LCD display 11. Accordingly, to present the user with a set of alternative options for controlling the security system the options may be labeled on display 11 above keys 12*a*, 12*b*, and 12*c*, and the option may be selected by actuating one of keys 12*a*, 12*b*, or 12*c*. These "soft" keys provide a simplified user interface because the keys are named only as needed and the same keys may be used for multiple functions without including multiple labels on the key.

Figure 3:
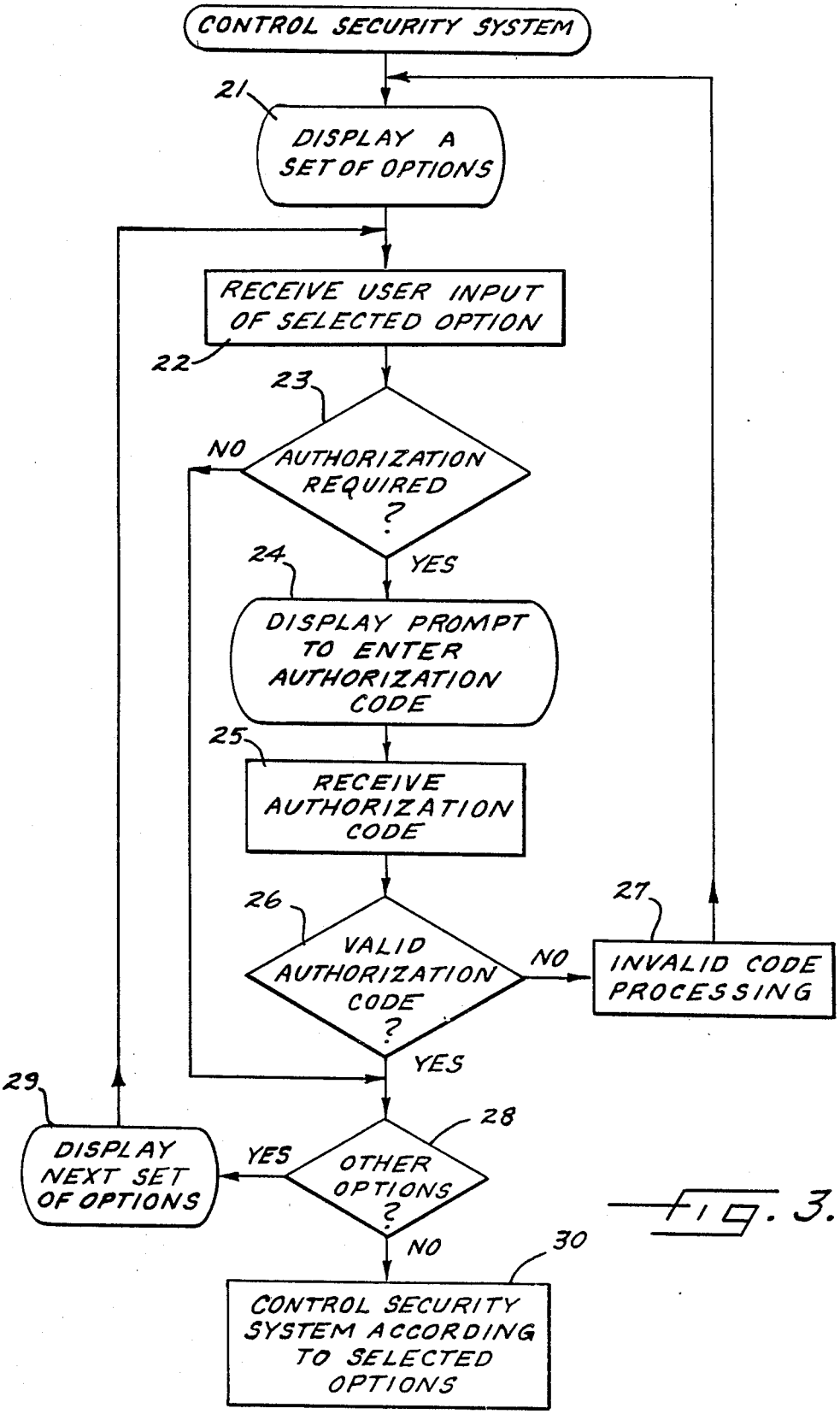
FIG. 3 is a block flow diagram illustrating the general logic and sequence of operations to control the operation of a security system according to the present invention.

Referring now to FIG. 3, the general logic and sequence of operations for controlling the security system will be described. It will be understood by those having skill in the art that the logic and sequence of operations may be implemented by a stored program which runs on microprocessor controller 13. As shown at block 21, a set of options is displayed for controlling a system function. Preferably, the function is displayed on display 11 and the options are displayed adjacent keys 12*a*, 12*b*, and 12*c*. Then, at block 22 user actuation of key 12*a*, 12*b*, or 12*c* is received to indicate the selected option. At block 23, if an authorization code is required in order to implement the selected option, then a prompt is displayed on display 11 to enter the authorization code (block 24). The authorization code is received (block 25) and is checked for validity at block 26. If the code is invalid, invalid code processing takes place as necessary (block 27), for example, by storing an indication that an invalid authorization code was entered. The selected option is not performed and the program returns to display a set of options. If the authorization code is valid, other options may need to be displayed in order to control the system. If other options need to be displayed (block 28), then a next set of options is displayed (block 29) and user input is again received (block 22). If other options are not needed, the security system is controlled according to the selected options (block 30).

Having described the general logic and sequence of operations, FIGS. 4, 5, 6 and 7 will now describe the logic and sequence of operations to control particular security system operations. For ease of understanding, a "display block" having curved sides, (for example blocks 21, 24 and 29 of FIG. 3) will indicate display of the message contained therein on display 11, and a rectangle (for example blocks 22, 25, 27 and 30 of FIG. 3) will indicate a processing operation. It will be understood that all blocks may be performed under control of microprocessor 13.

Figure 4:
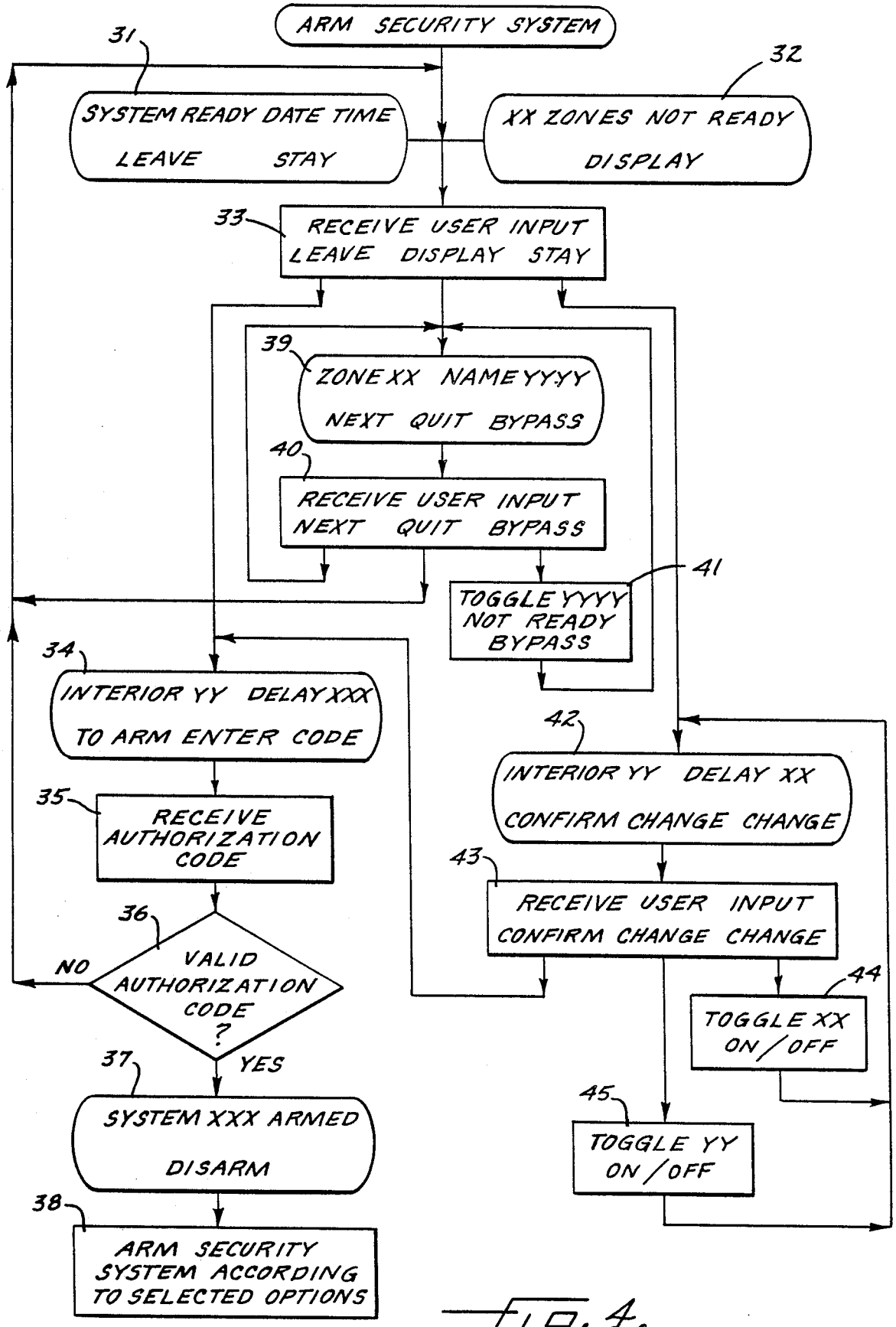
FIG. 4 is a block flow diagram illustrating the logic and sequence of operations to arm a security system according to the present invention.

Referring now to FIG. 4 the logic and sequence of operations to arm the security system according to the present invention will be described. It will be understood by those having skill in the art that the function of arming a security system is well known in the art, so that the description of FIG. 4 concentrates on the system of prompts and programmable keys for simplifying the user interface according to the present invention. When the system is in a disarmed state, either the display of block 31 or the display of block 32 will be displayed. The display of block 31 is displayed when all zones in the systems are ready so that the system may be immediately armed. The display of block 32 is displayed when one or more zones are not ready with "XX" in block 32 indicating the number of zones which are not ready. If all the zones are ready then display 31 labels keys 12*a* and 12*c* for the option of "LEAVE" or "STAY" respectively. It will be understood by those having skill in the art that a security system typically includes a number of zones, some of which monitor the perimeter of the site to be monitored, for example using sensors on doors or windows and motion detectors outside the site, while other detectors detect interior zones at the site, for example using motion detectors within a site. Accordingly, the "LEAVE" option will arm all interior and perimeter zones, while the "STAY" option will only arm the perimeter zones.

If one or more zones are not capable of being armed, the display 32 will be displayed rather than display 31, because the system will not allow the system to be armed when there are unsecured zones which are not first bypassed. Accordingly, the display of zone 32 permits only a single option; that is "DISPLAY" for key 12*b*.

Figures 5, 6:
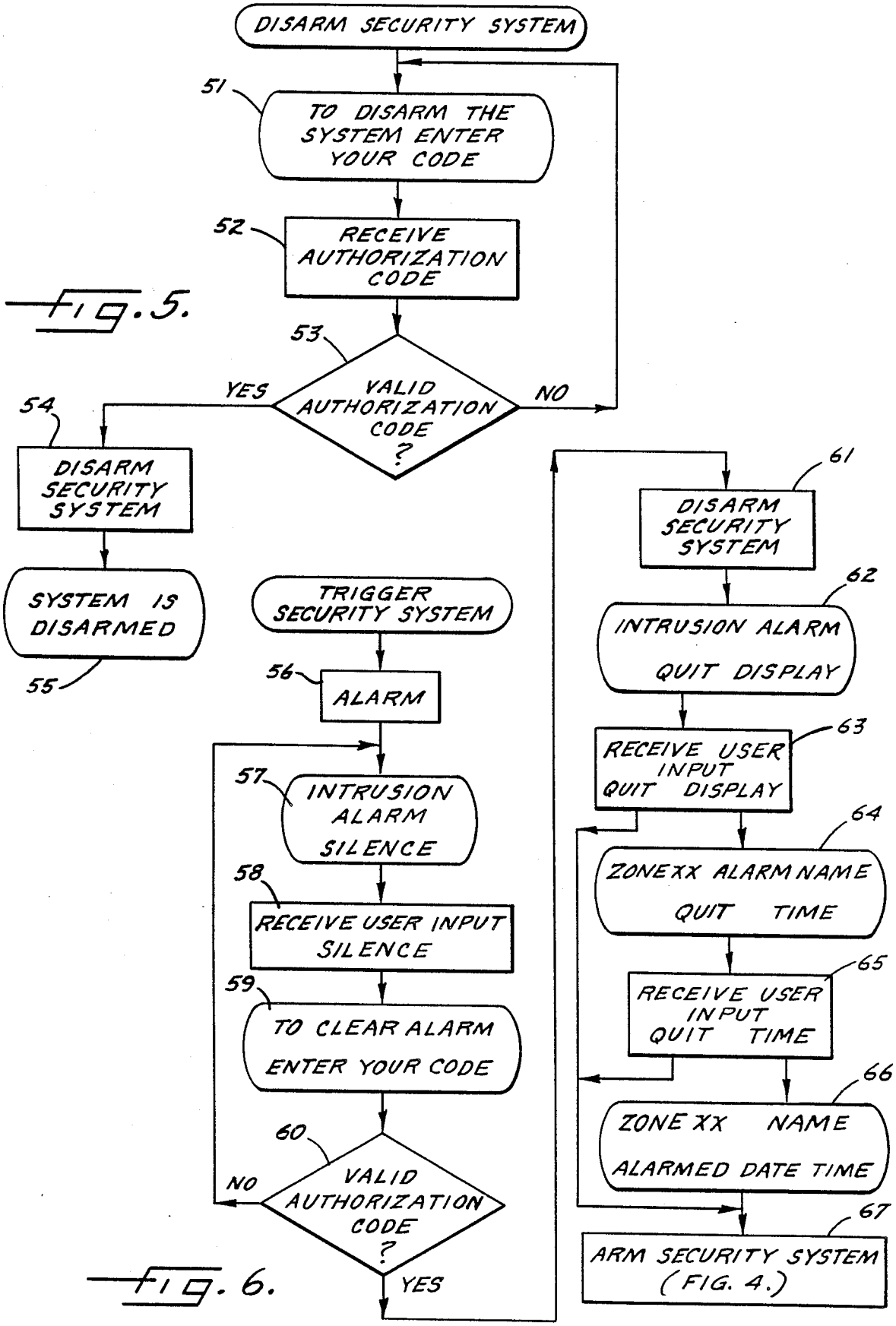
FIG. 5 is a block flow diagram illustrating the logic and sequence of operations to disarm a security system according to the present invention.
FIG. 6 is a block flow diagram illustrating the logic and sequence of operations to trigger a security system according to the present invention.

At block 33 the user input is received with actuation of keys 12*a* or 12*b* corresponding to the "LEAVE" or "STAY" option of block 31 and actuation of key 12*b* corresponding to the "DISPLAY" option of block 32. If the "LEAVE" option is selected the display of block 34 is displayed. The display of block 34 indicates at "YY" whether interior zones are "ON" or "OFF" and indicates at "XXX" whether an alarm delay is "ON" or "OFF". The prompt "TO ARM ENTER CODE" is also displayed. At block 35 the system receives an authorization code and at block 36 the system tests whether the authorization code is valid. If the authorization code is not valid block 31 is again displayed. The system may keep track of the number of invalid authorization code attempts and perform other processing when this number exceeds a predetermined number. When a valid authorization code is entered the display of block 37 is displayed. When the "leave" option has previously been selected the display will read "SYSTEM ARMED". The "DISARM" option is also displayed for key 12*a*. If selected, the logic and sequence of operations described in FIG. 5 is begun. At block 38 the system arms itself according to the options which were selected.

Referring again to block 33, when the "STAY" option is selected, the display of block 42 is displayed. The "YY" indicates that the interior zones are "ON" or "OFF", and "XX" indicates whether delay is "ON" or "OFF" At block 43, the system receives user input of the options to "CONFIRM" "CHANGE" the interior zones or to "CHANGE" the delay on/off status. If a confirm input is received (corresponding to key 12*a*) then the display of FIG. 34 is displayed. If the "CHANGE" option corresponding to key 12*b* is received then at block 45 the interior zones are toggled between "ON" and "OFF" in display 42. If the "CHANGE" option corresponding to key 12*c* is received, then the delay is toggled between "ON" and "OFF" at block 44.

Referring again to block 33 if the "DISPLAY" option is received (corresponding to actuation of key 12*b*), then the display of block 39 is displayed where "XX" indicates the number of the zone, "NAME" indicates the name of the zone (for example "BEDROOM 1") and "YYYY" indicates either "NOT READY" or "BYPASS". Then, at block 40, a user input of key 12*a*, 12*b*, or 12*c* is received. If "NEXT" is input (key 12*a*) then the next zone is displayed at block 39. If "BYPASS" is input (key 12*c*) then at block 41 the zone status is changed between "NOT READY" and "BYPASS". If "QUIT" is selected (key 12*b*) then the display of block 32 is again displayed.

It will be understood by those having skill in the art that display 39 and subsequent processing repeats until all of the unsecured zones are displayed and consciously bypassed by the user. When all unsecured zones have either been bypassed or secured, then the system may be armed for leaving or staying (block 31).

Referring now to FIG. 5, the logic and sequence of operations for disarming a security system according to the present invention will now be described. Disarming begins with the prompt of block 51. It will be understood that block 51 may be displayed as a result of user input of the "DISARM" option shown in block 37 of FIG. 4. Then, at block 52, an authorization code is received, and at block 53 a test for valid authorization code is performed. If the code is valid then at block 54 the security system is disarmed and the display of block 55 is displayed. Thereafter, processing returns to block 31 or 32 of FIG. 4.

Referring now to FIG. 6, the logic and sequence of operations to trigger a security system according to the present invention will be described. When the system detects an intrusion, an alarm is sounded at block 56. It will be understood by those having skill in the art that the alarm may be a siren, lights, a silent alarm or a call to the police or other authorities or the equivalent thereof. It will also be understood by those having skill in the art that an alarm may be sounded after a suitable delay from the time an intrusion is detected to allow for disarming. When the alarm sounds, the display of block 57 is displayed, thus providing for a prompt to "SILENCE" the alarm. When user input to "SILENCE" the alarm is received at block 58, for example by depressing key 12*a*, the display of block 59 is displayed, prompting for entry of an authorization code. If an invalid authorization code is entered (block 60) the alarm continues. If a valid authorization code is entered then the security system is disarmed (block 61) and block 62 is displayed to provide an option to "QUIT" or to "DISPLAY" the alarm. At block 63 a user input is received either to "QUIT" or to "DISPLAY" (keys 12*b* and 12*c* respectively). If "QUIT", processing returns to block 31 or 32 of FIG. 4 (block 67). If "DISPLAY", block 64 is displayed. At block 65 a user input to "QUIT" or display "TIME" is received. If "QUIT", then processing returns to block 31 or 32 of FIG. 4 (block 67). If "TIME" (key 12*c*) is selected the display of block 66 is displayed where "XX" refers to the zone and "DATE" and "TIME" display the date and time of the intrusion. Then, after a delay, processing returns to block 31 or 32 of FIG. 4 (block 67).

Figure 7:
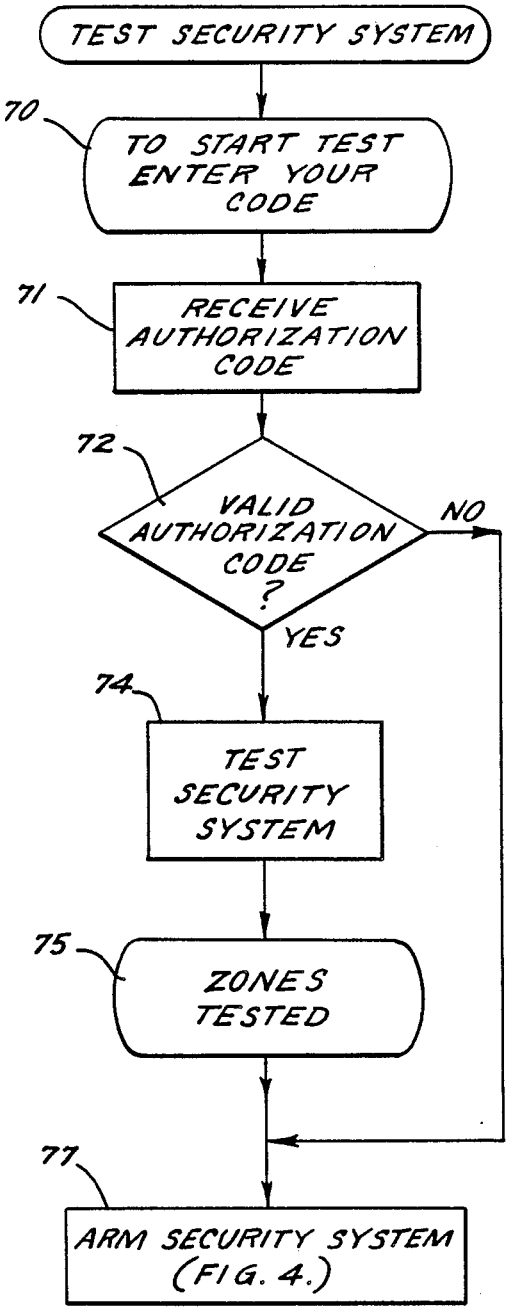
FIG. 7 is a block flow diagram illustrating the logic and sequence of operations to test a security system according to the present invention.

Referring now to FIG. 7 there is described the logic and sequence of operations to test the security system according to the present invention. The test of the security system is started by displaying the display block 70 to prompt for entry of the authorization code. Then, at block 71, an authorization code is received, and a test is made for a valid authorization code at block 72. If the authorization code is not valid then the test is not performed and the logic returns to FIG. 4 (block 77). If the authorization code is valid, then at block 74 the system test is performed and the system displays "ZONES TESTED" (block 75). Processing may then return to FIG. 4.

It will be understood by those having skill in the art that the above Description of the Preferred Embodiment has described the general control of a security system including prompts for multiple options and for an authorization code when necessary, wherein options are selected by displaying appropriate labels for selection keys. The specific operations of arming a security system for leaving and staying, for disarming a security system, and for testing the zones of a security system have been described. However, it will be understood by those having skill in the art that a user interface for other known functions of a security system may be provided according to the present invention. Added functions may be initiated by providing fixed keys for each added function. Alternatively, means may be provided for scrolling through a number of menus, which display options for initiating the various functions. To initiate a function, user would then depress key 12*a*, 12*b*, or 12*c*. To scroll from menu to menu, up and down keys or scrolling keys may be provided on the keypad.

It will be also understood by those having skill in the art that while a custom logic controller may be provided to perform the functions described above, the preferred embodiment of the invention performs these functions using a stored program which runs on a microprocessor controller. A stored program provides the advantage that new functions may be added by simply changing the stored program. In either case, according to the invention, the user need not memorize command sequences, or understand the logic or sequence of operations for controlling the security system. The user merely answers the prompts when displayed and selects an option when displayed. In an emergency situation a complex security system may easily be controlled by an inexperienced user.

In the drawings and specification, there have been disclosed typical preferred embodiments of the invention and, although specific terms are employed, they are used in a generic and descriptive sense only and not for purposes of limitation, the scope of the invention being set forth in the following claims.

That which we claim is:

1. A method of controlling the operation of a zone monitoring security system for monitoring at least one zone for at least one of physical intrusion and fire, comprising the steps of:

displaying to a user on a display device, a first set of alternative options for controlling the zone monitoring security system for monitoring at least one zone for at least one of physical intrusion and fire;

receiving user input of a selected one of said first set of alternative options;

in response to said user input, displaying a prompt to enter an authorization code;

receiving user input of an authorization code;

checking the validity of the received authorization code; and in response to user input of a valid authorization code, controlling the zone monitoring security system for monitoring at least one zone for at least one of physical intrusion and fire, according to said selected one of said first set of alternative options.

2. The method of claim 1 wherein the step of displaying a first set of alternative options for controlling the zone monitoring security system for monitoring at least one zone for at least one of physical intrusion and fire, comprises the steps of displaying a message defining a first option in said first set of alternative options adjacent a first user actuable key, and displaying a message defining a second option in said first set of alternative options adjacent a second user actuable key, and wherein the step of receiving user input of a selected one of said first set of alternative options comprises the step of testing first actuation of one of said first and second user actuable keys.

3. A method of controlling the operation of a security system comprising the steps of:

displaying to a user on a display device, a first set of alternative options for controlling the security system;

receiving user input of a selected one of said first set of alternative options;

in response to said user input, displaying a prompt to enter an authorization code;

receiving user input of an authorization code;

checking the validity of the received authorization code;

in response to user input of a valid authorization code, displaying a second set of alternative options corresponding to said selected one of said first set;

receiving user input of a selected one of said second set of alternative options; and controlling the security system according to said selected ones of said first and second sets of alternative options.

4. The method of claim 3 wherein the steps of displaying first and second sets of alternative options for controlling the security system comprise the steps of displaying a message defining a first option in said first and second sets of alternative options adjacent a first user actuable key and displaying a message defining a second option in said first and second sets of alternative options adjacent a second user actuable key, and wherein the steps of receiving user input of a selected one of said first and second sets of alternative options comprises the steps of testing for actuation of one of said first and second user actuable keys.

5. A method of controlling the operation of a zone monitoring security system for monitoring at least one zone for at least one of physical intrusion aND fire, comprising the steps of:

displaying to the user on a display device, a first set of alternative options for arming said zone monitoring security system for monitoring at least one zone for at least one of physical intrusion and fire;

receiving a first user input of a selected one of said first set of alternative options;

in response to said first user input, displaying a prompt to enter an authorization code;

receiving user input of an authorization code;

checking the validity of the received authorization code; and in response to user input of a valid authorization code, arming the zone monitoring security of system for monitoring at least one zone for at least one of physical intrusion and fire, according to said selected one of said first set of alternative options.

6. A method of controlling the operation of a security system comprising the steps of:

displaying to the user on a display device, a first set of alternative options for arming said security system;

receiving a first user input of a selected one of said first set of alternative options;

in response to said first user input, displaying a prompt to enter an authorization code;

receiving user input of an authorization code;

checking the validity of the received authorization code; and in response to user input of a valid authorization code, arming the security system according to said selected one of said first set of alternative options, wherein the step of displaying a first set of alternative options for arming said security system comprises the steps of displaying a message defining a first arming option adjacent a first user actuable key and displaying a message defining a second arming option adjacent a second user actuable key, and wherein the step of receiving a first user input of a selected one of said first set of alternative options comprises the step of detecting actuation of one of said first and second user actuable keys.

7. A method of controlling the operation of a security system comprising the steps of:

displaying to the user on a display device, a first set of alternative options for arming said security system;

receiving a first user input of a selected one of said first set of alternative options;

in response to said first user input, displaying a prompt to enter an authorization code;

receiving user input of an authorization code;

checking the validity of the received authorization code; and in response to user input of a valid authorization code, arming the security system according to said selected one of said first set of alternative options, wherein the security system monitors a plurality of monitoring zones, and wherein the step of arming the security system according to said selected one of said first set of alternative options comprises the step of:

arming first ones of said plurality of monitoring zones in response to said first user input selecting a first one of said first set of alternative options and arming second ones of said plurality of monitoring zones in response to said first user input selecting a second one of said first set of a alternative options.

8. The method of claim 7 further comprising the steps of:

(a) displaying to the user on said display device, an indication of the status of a first monitoring zone and a second set of options for maintaining and changing the status of said first monitoring zone;

(b) receiving a second user input of a selected one of said second set of options; and in response to said second user input, repeating steps (a) and (b) for a next one of said plurality of monitoring zones.

9. The method of claim 8 wherein the step of displaying an indication of the status of a first one of said plurality of monitoring zones comprises the step of displaying an indication of whether said first one of said plurality of monitoring zones is secure or is bypassed.

10. A method of controlling the operation of a security system comprising the steps of:

displaying to the user on a display device, a first set of alternative options for arming said security system;

receiving a first user input of a selected one of said first set of alternative options;

in response to said first user input, displaying a prompt to enter an authorization code;

receiving user input of an authorization code;

checking the validity of the received authorization code; and in response to user input of a valid authorization code, arming the security system according to said selected one of said first set of alternative options.

wherein the security system monitors plurality of interior and perimeter zones at a site; wherein the step of displaying a first set of alternative options for arming said security system comprises the steps of displaying a message defining a first arming option for leaving the site and displaying a message defining a second arming option for staying on the site; and wherein the step of arming the security system according to said selected one of said first set of alternative options comprises the steps of arming the interior and perimeter zones in response to the selection of said first arming option and arming only the perimeter zones in response to the selection of said second arming option.

11. A method of controlling the operation of a security system comprising the steps of:

displaying to the user on a display device, a first set of alternative options for arming said security system;

receiving a first user input of a selected one of said first set of alternative options;

in response to said first user input, displaying a prompt to enter an authorization code;

receiving user input of an authorization code;

checking the validity of the received authorization code; and in response to user input of a valid authorization code, arming the security system according to said selected one of said first set of alternative options.

wherein the security system monitors a plurality of zones, and wherein the method of controlling the operation of the security system further comprises the step of:

in response to a user input, testing each of said plurality of zones for arming.

12. A method of controlling the operation of a security system comprising the steps of:

detecting an intrusion;

in response to said intrusion, displaying on a display device an alphanumeric message to enter an authorization code;

receiving first user input of an authorization code;

checking the validity of the first received authorization code;

in response to first user input of a valid authorization code, disarming the security system;

in response to first user input of an invalid authorization code, activating an alarm and displaying on the display device an alphanumeric message to enter an authorization code;

receiving second user input of an authorization code;

checking the validity of the second received authorization code; and in response to second user input of a valid authorization code, deactivating said alarm.

13. A security system comprising:

a controller;

a display, operationally connected to said controller;

a user input device, operationally connected to said controller;

first means, associated with said controller, for displaying on said display device, a first set of alternative options for controlling said security system, second means, associated with said controller, for receiving user input at said input device of a selected one of said first set of alternative options;

third means, associated with said controller, for displaying a prompt to enter an authorization code;

fourth means, associated with said controller, for receiving a user authorization code entered at said user input device, and for checking the validity of the received authorization code;

fifth means, associated with said controller, for displaying on said display a second set of alternative options corresponding to said selected one of said first set of alternative options, if said user authorization code is valid;

sixth means, associated with said controller, for receiving user input at said input device of a selected one of said second set of alternative options; and seventh means, associated with said controller, for controlling the security system according to said selected ones of said first and second sets of alternative options.

14. The security system of claim 13 wherein said user input device is a keypad, located adjacent to said display; wherein said first and fifth means display the first option in respective first and second sets of alternative options adjacent a first key in said keypad, and display the second option in the respective first and second sets of alternative options adjacent a second key in said keypad; and wherein said second and sixth means comprise means for receiving an indication that one of said first and second keys is actuated.

15. The security system of claim 13 wherein said controller comprises a microprocessor and wherein said first through seventh means associated with said controller include sets of stored instructions executable by said microprocessor.

16. The security system of claim 15 further comprising additional sets of stored instructions also executable by said microprocessor for performing other functions of the security system.

17. A zone monitoring security system for monitoring at least one for at least one of physical intrusion and fire, comprising:

a controller;

a display, operationally connected to said controller;

a user input device, operationally connected to said controller;

first means, associated with said controller, for displaying on said display device a first set of alternative options for controlling said zone monitoring security system for monitoring at least one zone for at least one of physical intrusion and fire;

second means, associated with said controller, for receiving user input at said user input device of a selected one of said first set of alternative options;

third means, associated with said controller, for displaying a prompt to enter an authorization code;

fourth means, associated with said controller, for receiving a user authorization code entered at said user input device, and for checking the validity of the received authorization code; and fifth means, associated with said controller, for controlling the zone monitoring security system for monitoring at least one zone for at least one of physical intrusion and fire, according to said selected one of said first set of alternative options if said received user authorization code is valid.

18. The zone monitoring security system for monitoring at least one zone for at least one of physical intrusion and fire, of claim 17 wherein said user input device is a keypad, located adjacent said display, wherein said first means displays said first option in said first set of alternative options adjacent a first key in said keypad and displays said second option in said first set of alternative options adjacent a second key in said keypad; and wherein said second means comprises means for receiving an indication that one of said first and second keys is actuated.

19. A security system comprising:

a controller;

a display, operationally connected to said controller;

a user input device, operationally connected to said controller;

first means, associated with said controller, for displaying on said display device a first set of alternative options for controlling said security system;

second means, associated with said controller, for receiving user input at said user input device of a selected one of said first set of alternative options;

third means, associated with said controller, for displaying a prompt to enter an authorization code;

fourth means, associated with said controller, for receiving a user authorization code entered at said user input device, and for checking the validity of the received authorization code; and fifth means, associated with said controller, for controlling the security system according to said selected one of said first set of alternative options if said received user authorization code is valid;

wherein said first set of options comprises a set of options for arming said security system; and wherein said fifth means comprises means for arming said security system according to said selected one of said set of options arming said security system.

20. The security system of claim 19 wherein said security system further comprises a plurality of sensors each for monitoring a respective one of a plurality of monitoring zones, and wherein said set of options for arming said security system comprises a first option for arming first ones of said plurality of monitoring zones and a second option for arming second ones of said plurality of monitoring zones.

21. A security system comprising:

a controller;

a display, operationally connected to said controller;

a user input device, operationally connected to said controller;

first means, associated with said controller, for displaying on said display device a first set of alternative options for controlling said security system;

second means, associated with said controller, for receiving user input at said user input device of a selected one of said first set of alternative options;

third means, associated with said controller, for displaying a prompt to enter an authorization code;

fourth means, associated with said controller, for receiving a user authorization code entered at said user input device, and for checking the validity of the received authorization code;

fifth means, associated with said controller, for controlling the security system according to said selected one of said first set of alternative options if said received user authorization code is valid;

a plurality of sensors, operability connected to said controller, each for monitoring a respective one of a plurality of monitoring zones;

sixth means, associated with said controller, for displaying on said display device, an indicator of the status of a monitoring zone and a second set of alternative options for maintaining and changing the status of said monitoring zone; and seventh means, associated with said controller, for receiving user input at said user input device of a selected one of said second set of alternative options.

22. The security system of claim 21 wherein said indication of the status of a monitoring zone comprises an indication of whether said monitoring zone is secure or is bypassed.

23. A security system comprising:

a controller;

a display, operationally connected to said controller;

a user input device, operationally connected to said controller;

first means, associated with said controller, for displaying on said display device a first set of alternative options for controlling said security system;

second means, associated with said controller, for receiving user input at said user input device of a selected one of said first set of alternative options;

third means, associated with said controller, for displaying a prompt to enter an authorization code;

fourth means, associated with said controller, for receiving a user authorization code entered at said user input device, and for checking the validity of the received authorization code;

fifth means, associated with said controller, for controlling the security system according to said selected one of said first set of alternative options if said received user authorization code is valid;

a first plurality of sensors connected to said controller, for monitoring interior zones and a second plurality of sensors for monitoring perimeter zones; and wherein said set of options for arming said security system comprises a first option for arming said interior and said perimeter zones and a said second option for arming only said perimeter zones.

24. A security system comprising:

a controller;

a display, operationally connected to said controller;

a user input device, operationally connected to said controller;

first means, associated with said controller, for displaying on said display device a first set of alternative options for controlling said security system;

second means, associated with said controller, for receiving user input at said user input device of a selected one of said first set of alternative options;

third means, associated with said controller, for displaying a prompt to enter an authorization code;

fourth means, associated with said controller, for receiving a user authorization code entered at said user input device, and for checking the validity of the received authorization code;

fifth means, associated with said controller, for controlling the security system according to said selected one of said first set of alternative options if said received user authorization code is valid;

a plurality of sensors for monitoring a respective plurality of zones; and eighth means, associated with said controller, for testing said plurality of sensors.

25. The security system of claim 19 wherein said controller comprises a microprocessor and wherein said first through fifth means associated with said controller include sets of stored instructions executable by said microprocessor.

26. The security system of claim 25 further comprising additional sets of stored instructions also executable by said microprocessor for preparing other functions of the security system.

* * * * *

UNITED STATES PATENT AND TRADEMARK OFFICE

CERTIFICATE OF CORRECTION

PATENT NO. : 4,931,769

DATED : June 5, 1990

INVENTOR(S) : Kirk B. Phillips, et al.

It is certified that error appears in the above-identified patent and that said Letters Patent is hereby corrected as shown below:

Column 4, line 56, a period -- . -- should follow "OFF".

Column 7, line 12, "first" (first occurrence) should be -- for --.

Column 7, line 48, "aND" should be -- and --.

Column 7, line 63, "of" should be deleted.

Column 10, line 47, after "one" (first occurrence) insert -- zone --.

Column 14, line 6, "preparing" should be -- performing --.

Signed and Sealed this

Seventeenth Day of December, 1991

*Attest:*

HARRY F. MANBECK, JR.

*Attesting Officer*

*Commissioner of Patents and Trademarks*